United States Patent [19]

Elbe et al.

[11] 4,079,535

[45] Mar. 21, 1978

[54] RIFLE ADAPTER ASSEMBLY MAGAZINE

[75] Inventors: Ronald E. Elbe, Davenport, Iowa; Donald W. Krolak, Rock Island, Ill.; Philip L. Vernon, Montpelier, Iowa

[73] Assignee: The United States of America as represented by the Secretary of the Army, Washington, D.C.

[21] Appl. No.: 763,769

[22] Filed: Jan. 31, 1977

Related U.S. Application Data

[63] Continuation-in-part of Ser. No. 617,203, Sep. 26, 1975.

[51] Int. Cl.[2] ..... F41C 25/02

[52] U.S. Cl. ..... 42/49 A; 42/50

[58] Field of Search ..... 42/49 A, 50, 6, 7

[56] References Cited

U.S. PATENT DOCUMENTS

| | | | |
|---|---|---|---|
| 1,299,303 | 4/1919 | Cowles | 42/50 |
| 1,331,155 | 2/1920 | Johnson | 42/50 |
| 1,351,370 | 8/1920 | Chase | 42/50 |
| 1,407,633 | 2/1922 | Burton | 42/50 |
| 2,396,816 | 3/1946 | Boudreau | 42/50 |
| 2,840,944 | 7/1958 | Thompson | 42/50 |
| 2,895,248 | 7/1959 | Sawin | 42/50 |
| 3,771,415 | 11/1973 | Into et al. | 42/49 A |
| 3,776,095 | 12/1973 | Atchisson | 42/49 A |

FOREIGN PATENT DOCUMENTS

| | | | |
|---|---|---|---|
| 1,166,052 | 3/1964 | Germany | 42/49 A |

*Primary Examiner*—Charles T. Jordan

*Attorney, Agent, or Firm*—Nathan Edelberg; Harold H. Card; Robert O. Richardson

[57] ABSTRACT

A magazine for a rimfire adapter to feed cartridges into a rifle in which the cartridges are shorter than those for which the rifle was intended. The magazine cavity is positioned rearwardly, in order for the base of the shorter cartridges to be positioned longitudinally in the same position the original cartridge would have been if it were used. This overcomes the double firing safety hazard while suitable ramps and guides are positioned forwardly to guide cartridge travel forward to the chamber.

6 Claims, 3 Drawing Figures

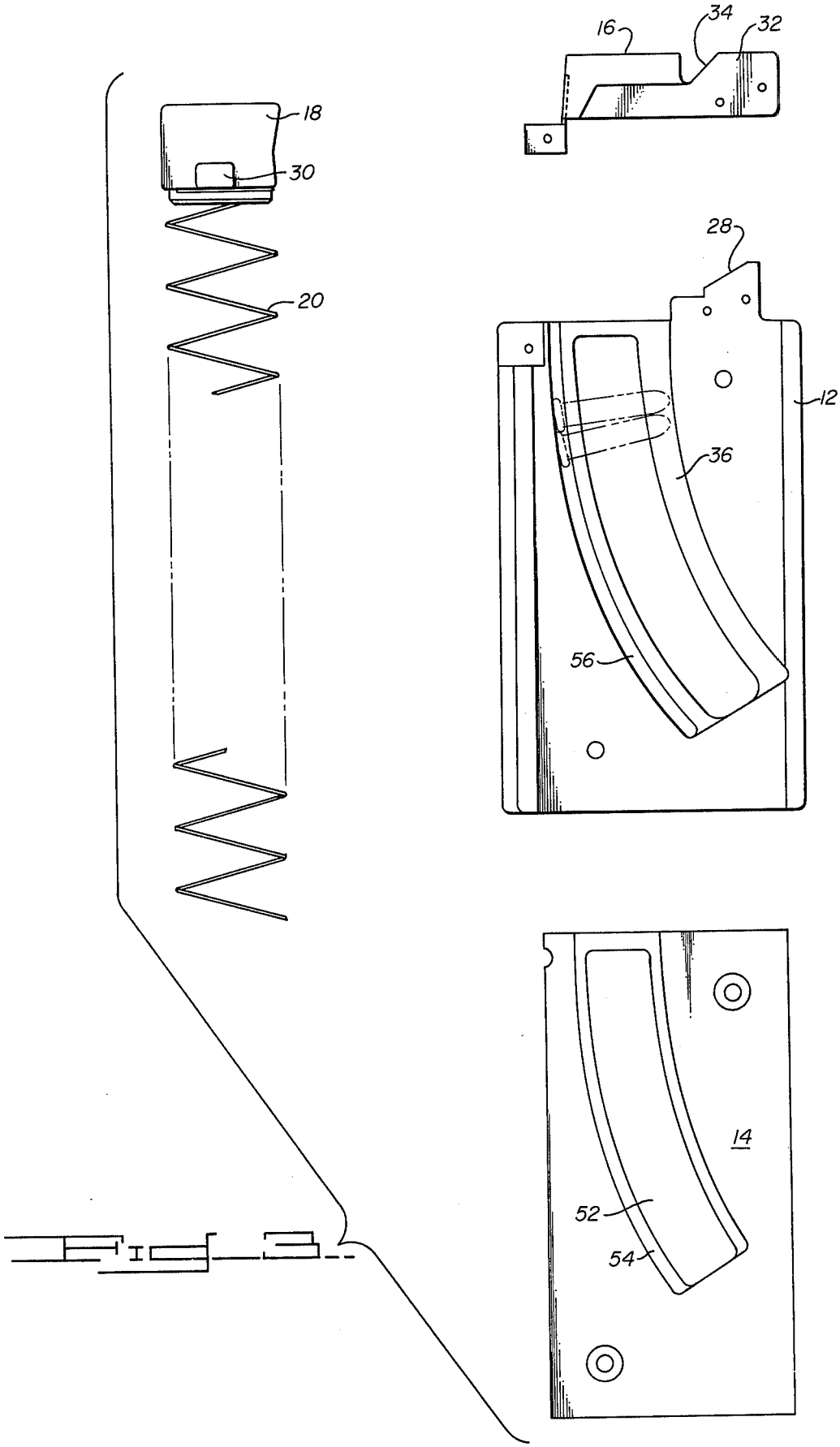
16
34
32
18
30
20
28
12
36
56
14
52
54

RIFLE ADAPTER ASSEMBLY MAGAZINE

GOVERNMENT RIGHTS

The invention described herein may be manufactured and/or used by or for the Government for governmental purposes without the payment of any royalty thereon.

BACKGROUND OF THE INVENTION

This is a continuation-in-part of copending patent application Ser. No. 617,203 for Rifle Adapter Assembly filed Sept. 26, 1975.

Unlike rifles used for hunting wild game for sport, standard firearms used by military services are typically desiged for use against human targets, at long range, and with precise accuracy. The ammunition best suited for the foregoing requirements is usually not large in caliber of the projectile, but having a shell casing adapted to holding a large quantity of powder. Such ammunition, as used for most military firearms, is of the center fire type requiring a small ignition cap primer mounted at the center in the base of each round to ignite the main powder charge.

The manufacturing cost of ammunition such as that described above is understandably high, and involves larger quantities of metal and powder than would small rounds such as the familiar caliber .22 rimfire rounds widely used for hunting small game and for inexpensive target practice by the general public. The latter type of ammunition characteristically has a volume of powder smaller than the volume of the projectile itself, and has no separate primer in the shell base, since it is rim fired. For training purposes, where simple handling and target practice with military firearms is taught to recruits, it would obviously be a very substantial saving in dollars as well as conservation of materials if such firearms could be adapted to use the inexpensive rimfire ammunition in place of the expensive center fire type for which the weapons were originally designed. Moreover, smaller and more accessible firing ranges are adequate for training when the smaller ammunition is used.

A Rifle Conversion Assembly U.S. Pat. No. 3,771,415 issuing to Henry A. Into et al Nov. 13, 1973, and a Weapon Conversion Bolt Assembly Device U.S. Pat. No. 3,776,095 issuing to Maxwell G. Atchisson Dec. 4, 1973, relate to devices for converting a firearm of one caliber to one of a smaller caliber. They provide for a unitary bolt assembly that may be substituted for the standard bolt assembly in the weapon. They include a conversion chamber adapter with a bolt mounted for movement between recoil and battery positions. They each have a backplate damper to assist in maintaining the operating components in assembly and to absorb recoil impact energy of the bolt upon firing of the weapon. The bolt slides longitudinally between the conversion chamber and the backplate damper. An extractor and firing pin ride on the bolt and an ejector is positioned on the assembly frame to eject cartridge casings as the bolt recoils rearwardly when a cartridge has been fired.

SUMMARY OF THE PRESENT INVENTION

In accordance with the present invention a magazine is provided for storing and feeding to a rifle adapter assembly ammunition other than that for which the basic rifle was originally designed. The magazine comprises a plastic box with a detachable plastic cover. This box is adapted to fit onto the gun in the same manner as the magazine it replaces that feeds cartridges of the size the gun was designed to fire. The box has an integral feed ramp and internal cavities to accommodate, locate, and guide the cartridges, follower and spring. The follower includes a handle designed to facilitate easy loading and unloading of the cartridges from the magazine. Feed lips extend over the entire length of the upper cartridge and incorporates integral round guides and rim ramps to control the cartridge as it is fed forwardly from the magazine. Contrary to conventional design practice of locating the cartridges forwardly in the magazine to minimize travel in chambering, cartridges in the present magazine are located rearwardly so that the cartridge base is in longitudinal alignment with the base of cartridges normally used in the gun. This eliminates the double firing hazard of other conversion assemblies that permit feeding of fresh cartridges into the gun chamber when there is insufficient recoil to cock the hammer.

BRIEF DESCRIPTION OF THE DRAWINGS

FIG. 3 is an exploded view of the disassembled parts.

DETAILED DESCRIPTION OF ILLUSTRATIVE EMBODIMENT

Figure 1:
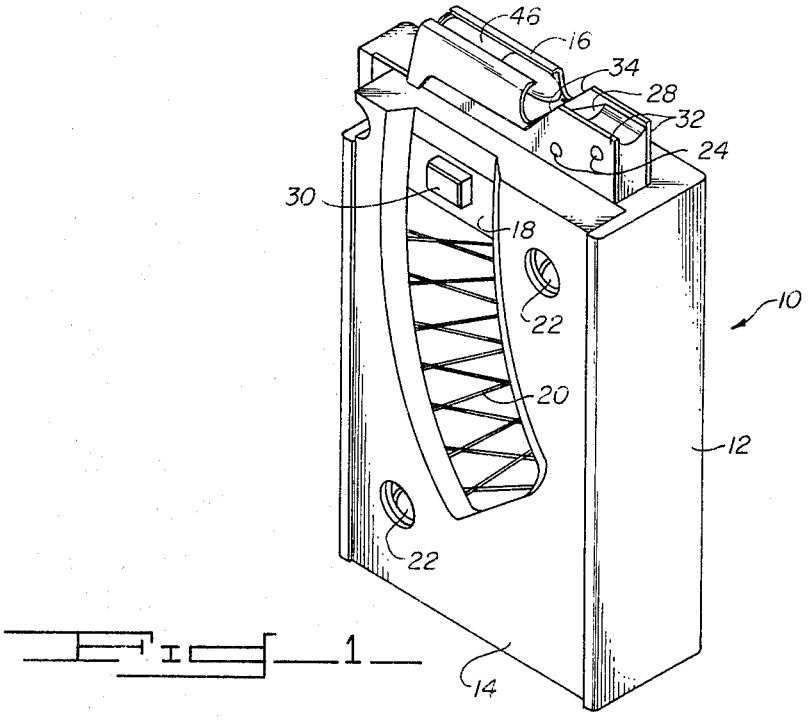
FIG. 1 is a perspective view of the adapter magazine.

Reference is made to FIG. 1 wherein there is shown a magazine assembly 10 having removably mounted thereon a cover 14 and feed lips 16. Contained between the box 12 and the cover 14 are a follower 18 and a spring 20. Integrally molded on follower 18 is a protruding button 30. This button is utilized to depress the follower 18 downwardly to facilitate easy loading and unloading of the magazine. The box 12, cover 14, and follower 18 preferably are all molded of a hard plastic. The extremely smooth surfaces obtainable by this manufacturing method minimizes friction between the follower and the box and cover, eliminating any need for lubrication. Suitable retaining means such as bolts 22 provide for ready disassembly of the box 12 and cover 14 to allow cleaning or replacement of damaged parts. Other suitable retaining means such as rivets 24 and a roll pin 26 (see FIG. 2) provide secure stable assembly of the feed lips 16 to the box 12 while still allowing replacement of the feed lips should they become damaged. The feed lips 16 extend over the entire length of the round in feed position. In addition, the feed lips 16 are turned in, as shown, to retain cartridges in the magazine. The box incorporates an integral feed ramp 28 at the top which serves to guide the nose of the cartridge toward the firing chamber as the bolt starts forward. During the initial forward movement of the cartridge, lateral movement is controlled by the round guides 32, which are vertically projecting forward extensions of the feed lips 16. Inclined rim ramps 34 form the rearward edge of the round guides 32. These ramps serve to further position the cartridge as the feed cycle progresses, i.e., as the base of the cartridge is freed from the feed lips 16 and continues forward, the base or rim of the cartridge contacts the rim ramps 34. The cartridge rim then rides up the ramps 34 which levels the cartridge, providing alignment with the chamber. This system of ramps and guides assures reliable feeding throughout the abnormally long feed travel distance, which will be further described later herein.

Figure 2:
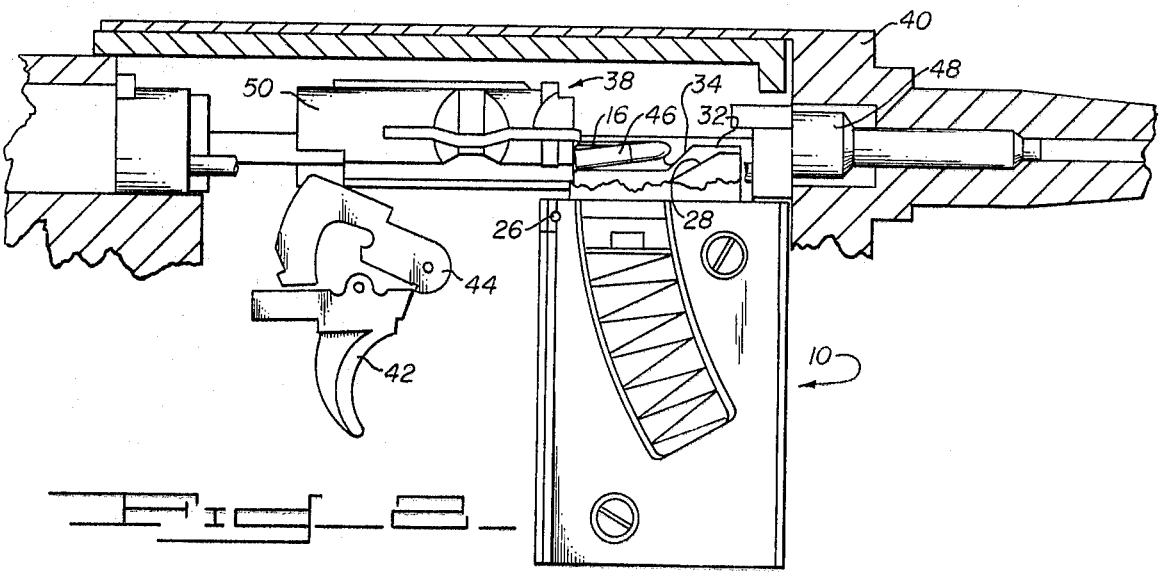
FIG. 2 is a side elevational view of the magazine and conversion assembly.

In FIG. 2 there is shown a magazine assembly 10 of the present invention and a conversion device 38 in a rifle receiver 40 showing the relationship with the trigger 42 and hammer 44.

It is normally considered good and standard design practice in all weapons to locate the cartridge (when it is in the magazine ready to be fed) as close to the chamber mouth as possible. This practice minimizes the distance that the round 46 must travel from the magazine 10 to the weapon's chamber 48, thereby minimizing the attendant risk of feed malfunctions. All weapons and all known conversion assemblies similar in nature to this follow that design practice. However, when a rifle is converted to the firing of a cartridge shorter than that for which it was originally designed, following that "good" and "standard" design practice leads to an extremely hazardous condition, runaway firing (unintentional firing of more than one round with one trigger pull). This hazard is caused when the bolt 50, recoiling rearwardly from the firing of a previous cartridge, reaches the position where it could feed a fresh cartridge before it has cocked the hammer 44. If recoil stops before the hammer is cocked, counterrecoil or forward movement of the bolt 50 will feed a fresh cartridge into the chamber 48 and the unlocked hammer 44, under the urging of its spring, will follow the bolt forward and fire the cartridge.

Two novel methods of alleviating this hazardous condition have been found. One method is to shorten the distance of hammer travel. This method is particularly suited to the modification of already fabricated adapters. It is disclosed in copending patent application Ser. No. 619,154 for Modification of Rifle Adapter Assembly to Prevent Doubling filed Oct. 3, 1975, now U.S. Pat. No. 4,008,537.

The other method as taught by this invention is to locate the ready round in the magazine well rearward of the chamber so that the distance the bolt must recoil to cock the hammer is less than the distance the bolt must recoil to reach a position from which it could feed a fresh round. The magazine disclosed herein, when used in conjunction with a suitable adapter (such as that disclosed in copending patent application Ser. No. 617,203) provides the proper longitudinal relationships between the cocking and feed positions to assure safe operation. In other words, the adapter magazine locates the rimfire cartridge base in the same longitudinal position as the rifle magazine with regular rifle cartridges. This concept assures the hammer is cocked before the bolt reaches a position where a new round can be fed.

In FIG. 3 there is shown in elevation the components of the magazine. In addition to the inherent safety of the magazine design as previously discussed, the magazine assembly contains numerous other new and useful features as shown. The box 12 incorporates integral internal cavities 36 to accommodate, locate and guide cartridges, the follower 18 and the spring 20. As shown, the cavities 36 are arcuately curved to facilitate the natural stacking position of rimfire cartridges (since the rim is of a larger diameter than the body of the cartridge). This configuration also allows the cartridges to be stacked in the magazine so that the rim of the uppermost cartridge is always forward of the rim of the next lower one. The position of the cartridges is further controlled by a recess 56 in the box 10 and a similar recess (not shown) in the cover. This assures smooth operation by eliminating interference between rims of adjacent cartridges. Incorporated in the cover 14 is a similarly curved slot 52 through which extends the button 30 on follower 18. Surrounding the slot 52 is a chamfered area 54 which provides for easy access to the button 30. Because the base of the round 46 sits at the back of the magazine, the feed lips 16 can be made long enough to cover and thereby protect the top cartridge in the magazine should the magazine be accidently dropped or struck. The feed ramp 28 integral with the box 12, and the rim ramps 34 and round guides 32 forwardly of the feed lips 16, assure positive reliable feeding of the cartridges throughout the unusually long feeding travel that this configuration necessitates for safety reasons. The inexpensive plastic box 12 with its plastic cover 14 and the plastic follower 18 minimize friction effects which are detrimental to reliable feeding, while the durable metal feed lips 16 assure long life of the necessarily thin cross-sectioned lip area.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A rimfire adapter magazine for feeding cartridges into a rifle wherein said cartridges are shorter in length than for which said rifle was designed, said magazine comprising:

a container having a cartridge holder cavity, a spring and cartridge follower in said cavity for urging cartridges therein upwardly, elongated spaced apart feed lips with inturned flanges at the top of said container against which the uppermost cartridge in said container is urged, said lips extending along the entire length of said cartridge, a slot in said container, said follower having a button thereon extending through said slot whereby manual depression on said button removes spring bias of said uppermost cartridge against said inturned flanges, said cartridge holder cavity, spring and cartridge follower being arranged whereby the base of the uppermost cartridge engages said lips in the same longitudinal position as the base of an original cartridge for which said rifle was designed.

2. A magazine for feeding cartridges into a rifle as in claim 1 wherein said container has a feed ramp thereon aligned with said lips over which cartridges pass as they are removed from said lips.

3. A magazine for feeding cartridges into a rifle as in claim 2 wherein said container has a rim ramp rearwardly of said feed ramp for elevating said cartridge as it leaves said magazine.

4. A magazine for feeding cartridges into a rifle as in claim 1 wherein said container consists of a box-like structure with a removable side cover over said cavity, said slot being in said cover.

5. A magazine for feeding cartridges as in claim 1 wherein a feed ramp, rim ramp and guides are positioned forwardly of said lips for guiding cartridge movement from said lips to said chamber.

6. A rimfire adapter magazine for feeding cartridges to a rifle wherein said cartridges are shorter than those for which said rifle was intended, said magazine having a cartridge storing cavity with elongated lips thereover to retain the uppermost cartridge in position for chambering, said lips extending along the entire length of said cartridge, said cavity having a recess therein engagable with the bases of cartridges stored in said cavity for longitudinal positioning thereof, said magazine having a feed ramp, rim ramp and guides forwardly of said lips for controlling cartridge movement from said lips to chamber position.

* * * * *